United States Patent [19]

Harig

[11] 4,219,175

[45] Aug. 26, 1980

[54] EXTENSIBLE SLOTTED UPRIGHT

[75] Inventor: Robert G. Harig, Paragould, Ark.

[73] Assignee: Darling Store Fixtures, Paragould, Ark.

[21] Appl. No.: 962,240

[22] Filed: Nov. 20, 1978

[51] Int. Cl.[2] ..... A47G 29/00; E04G 3/08

[52] U.S. Cl. ..... 248/125; 248/243

[58] Field of Search ..... 248/125, 407, 158, 157, 248/408, 409, 243, 354 P; 211/208

[56] References Cited

U.S. PATENT DOCUMENTS

| | | | |
|---|---|---|---|
| 1,429,456 | 9/1922 | Richmond | 211/208 X |
| 1,766,400 | 6/1930 | Neely | 248/407 |
| 3,006,706 | 10/1961 | Park et al. | 108/144 X |
| 3,285,208 | 11/1966 | Cohen | 248/408 X |
| 3,508,666 | 4/1970 | Schwengel | 211/208 |
| 3,601,432 | 8/1971 | Fenwick | 248/243 X |
| 3,804,355 | 4/1974 | Uroshevich | 248/125 |
| 3,983,822 | 10/1976 | Suttles | 248/243 X |

*Primary Examiner*—James T. McCall

*Attorney, Agent, or Firm*—Oliver E. Todd, Jr.

[57] ABSTRACT

An extensible slotted upright for mounting cantilever type brackets is disclosed. The upright is comprised of telescoping inner and outer tubes, each tube having a plurality of spaced apart slots along diametrically opposing sides for engagement by the bracket. The tubes are oriented with respect to each other such that each slotted side of the outer tube is adjacent and parallel to a slotted side of the inner tube. A spacer is positioned between the inner and outer tubes such that a bracket may be mounted through the slots of the outer tube without restriction or interference from the inner tube. Means are provided for securing the tubes in a predetermined telescoping position.

8 Claims, 5 Drawing Figures

EXTENSIBLE SLOTTED UPRIGHT

BACKGROUND OF THE INVENTION

The present invention relates to slotted tubular supports or uprights for mounting cantilever type brackets thereupon. Additionally, it relates to extensible or telescoping tubular bracket supports.

Slotted upright bracket supports and telescoping tubes are well known. However, if the two concepts are merely combined to embody an extensible or telescoping slotted upright bracket support, the resulting structure has restricted utility. The primary restriction of utility concerns that portion of the telescoping tubes which is overlapping. The inner tube must not hinder brackets from being inserted through the slots of the outer tube in the overlapping region. One means of preventing such hindrance is to design the tubes such that the slots of both are in alignment with each other, and the mounting tabs on brackets may then be inserted through the walls of both tubes. In that event, however, the brackets designed for use in the overlapping region may not be used where the tabs are inserted through only one wall thickness, since they will not fit properly. Thus, two types of brackets are needed.

SUMMARY OF THE INVENTION

The present invention is an extensible slotted upright having fully usable inner and outer tubes requiring a single type of bracket for engagement with each tube singly and in the overlapping region.

In a preferred embodiment, the invention is comprised of vertically oriented inner and outer tubes having rectangular cross sections in telescoping engagement with each other. Each of the tubes includes a plurality of spaced apart slots along and through one pair of opposed and parallel sides for insertion of the interlocking tabs on cantilever type brackets. The tubes are oriented with respect to each other such that each slotted side of the outer tube lies parallel to and spaced from a corresponding slotted side of the inner tube. The distance between the inner and outer tube slotted sides is sufficiently large that the bracket tabs may be inserted through the slots in the outer tube in the overlapping region without interference from the innser tube. Spacers are provided between the inner and outer tubes for maintaining a uniform spacing between the adjacent slotted sides throughout the telescoping range of the tube. With this arrangement, a single design of bracket may be used with each tube single or in the overlapping region.

Each slot on each tube is directly opposite a slot on the diametrically opposite and parallel side of such tube. A locking pin may then be inserted through the first pair of directly opposite slots in the inner tube immediately above the upper most end of the outer tube. The locking pin prevents the inner tube from telescopic retraction into the outer tube and their telescoping position with respect to each other is secured.

A cover plate is seated over the outer end of the inner tube, and is of such a size that it abuts the uppermost end of the outer tube when the upright is fully retracted, thereby concealing the inner tube. Even though the inner tube is fully retracted within the outer tube, the outer tube is fully usable with conventional brackets designed to engage a single thickness of metal.

It is an object of the present invention to provide an extensible slotted upright having inner and outer tubes which are fully usable with cantilever type brackets.

It is also an object of the present invention to provide an extensible slotted upright having inner and outer tubes at least partially overlapping which are usable with the same bracket.

Other objects and advantages of the present invention will be apparent to those persons skilled in the art in view of the following detailed description of a preferred embodiment.

DESCRIPTION OF THE PREFERRED EMBODIMENTS

Figure 1:
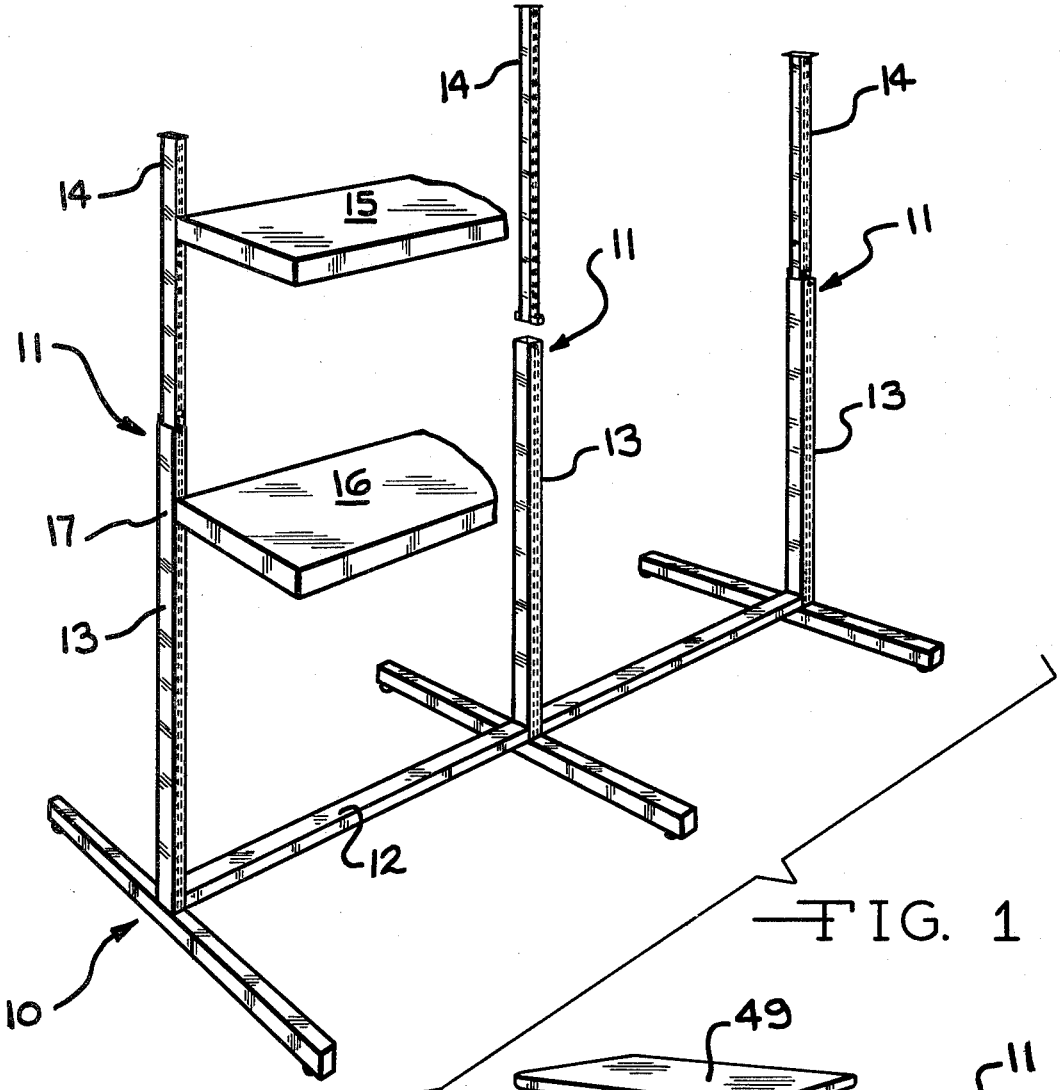
FIG. 1 is a fragmentary perspective view of a shelf fixture including three extensible slotted uprights for mounting shelves in accordance with the present invention.

In FIG. 1 a display fixture 10 is shown having a series of three extensible slotted uprights 11, in accordance with the present invention, mounted upon a base support 12. Each upright 11 is comprised of an outer tube 13 and a telescoping inner tube 14. Shelves 15 and 16 are shown in fragmentary mounted, respectively, upon the inner tube 14 and upon the outer tube 13 in an overlapping region 17 of the outer and inner tubes 13 and 14, as discussed more fully below.

Figure 2:
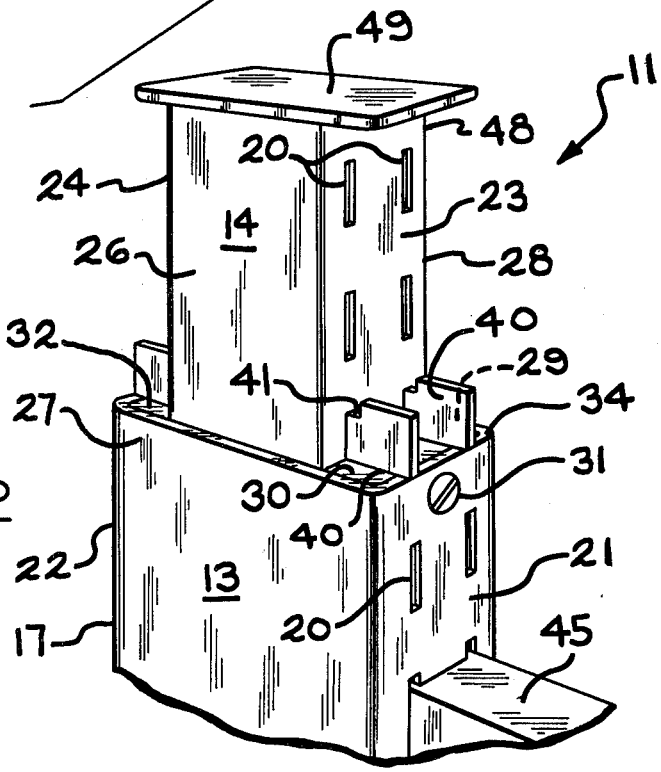
FIG. 2 is an enlarged fragmentary perspective view of a single upright locked in position.
Figure 3:
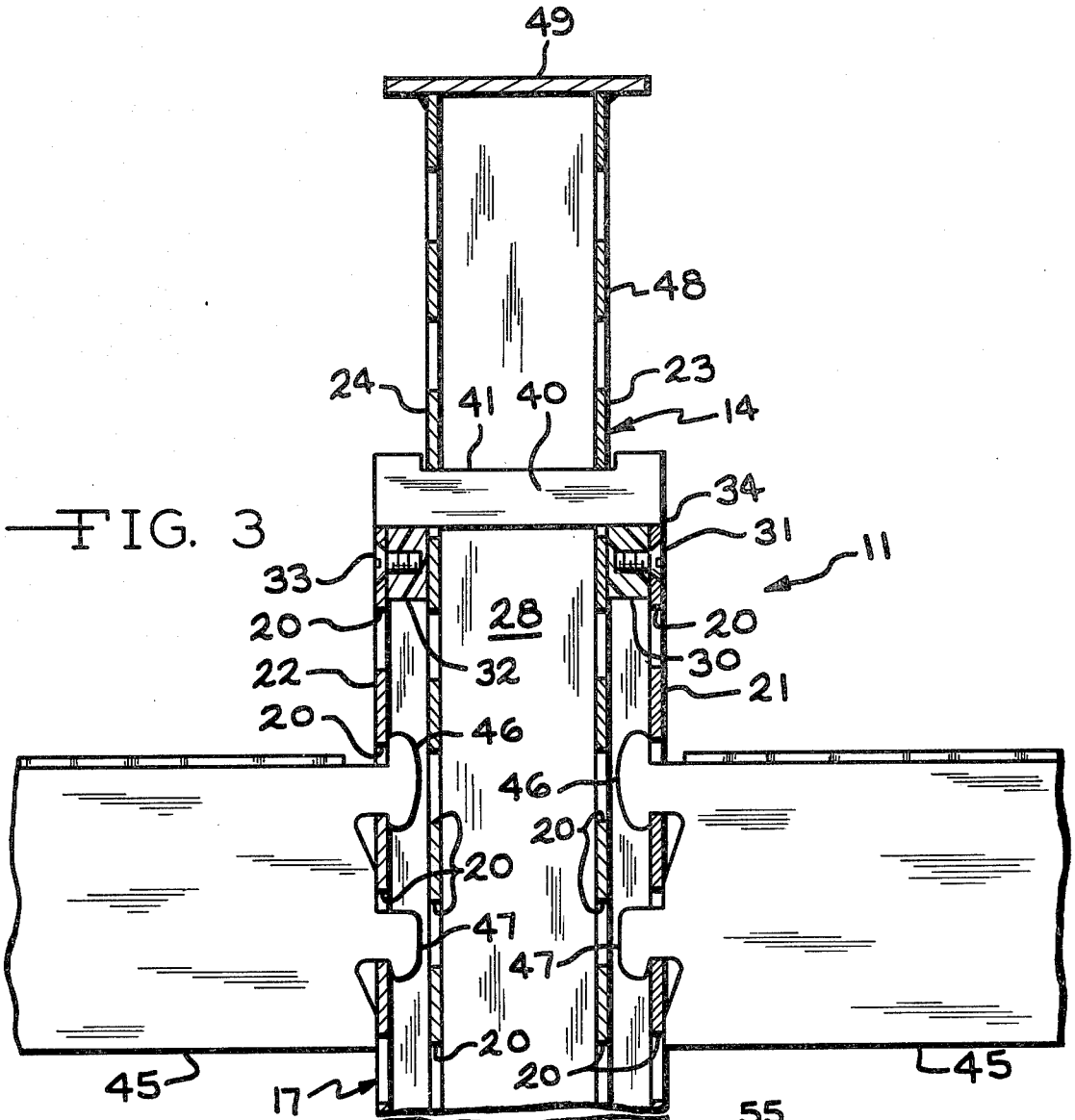
FIG. 3 is a fragmentary vertical cross sectional view of an extensible slotted upright having brackets mounted on opposite sides in the overlapping region of the outer and inner tubes.

A fragmentary portion of one embodiment of the extensible upright 10 is shown in detail in FIGS. 2 and 3. The outer tube 12 and the inner tube 13 are substantially rectangular in cross section. A plurality of spaced apart slots 20 extend in two vertical rows along and through opposing and parallel sides 21 and 22 of the tube 13 and 23 and 24 of the tube 14. Each slot 20 along the sides 21 and 23 is directly opposite and aligned with a similar slot 20 on the opposing side 22 or 24 for the same tube 13 or 14, respectively. The inner tube 14 also has a side 26 which abuts a side 27 of the outer tube 13 and the inner tube 14 has an opposite parallel side 28 which abuts a side 29 on the outer tube 13. The sides 26–29 are all parallel so that the sides 26 and 27 abut and the sides 28 and 29 abut as the inner tube 14 is telescoped into or out of the outer tube 13. The sides 23 and 24 of the inner tube 14 are spaced inwardly from the sides 21 and 22, respectively, of the outer tube 13. A spacer 30 is attached to the outer tube side 21 with a screw 31 and a similar spacer 32 is attached to the outer tube side 22 with a screw 33. The spacers 30 and 32 extend inwardly from a top end 34 of the outer tube 13 to engage the sides 23 and 24, respectively, of the inner tube 14. Similar spacers 35 and 36 are attached to the sides 23 and 24 of the inner tube 14 at a lower end 37 with bolts 38 located within the inner tube 14. The spacers 35 and 36 extend from the inner tube 14 and slidably abut the sides 21 and 22, respectively, of the outer tube 13. The spacers 30, 32, 35 and 36 maintain a parallel relationship between the tube sides 21, 22, 23 and 24 as the inner tube 14 is telescoped within the outer tube 13. The spacers 30, 32, 35 and 36 also maintain a predetermined spacing between the tube walls 21 and 23 and between the tube walls 22 and 24.

Two horizontally adjacent slots 20 on one side 23 of the inner tube 14 are directly opposite and in alignment with a similar two horizontally adjacent slots 20 on the opposite side 24 of the inner tube 14. This arrangement of the slots 20 on the inner tube 14 permits the insertion of two locking pins 40 through two pair of horizontally aligned slots 20. The two pins 40 are of such a length to extend between the spaced walls 21 and 22 of the outer tube 13 and to abut the end 34 of such walls. By such an arrangement, the locking pins 40 determine the axial or telescopic position of the inner tube 14 within the outer tube 13. The pins 40 are held in a position abutting the end 34 of the outer tube 13 by gravity acting upon the inner tube 14 and any brackets or other fixture components attached to the inner tube 14. The locking pins 40 are provided with a notched upper surface 41. The notched upper surface 41 is designed to engage the inner tube walls 23 and 24 to prevent the locking pins 40 from escaping from the slots 20. In order to remove the locking pins 40 from the slots 20, it is necessary to slightly raise or extend the inner tube 14 from the outer tube 13.

Figure 4:
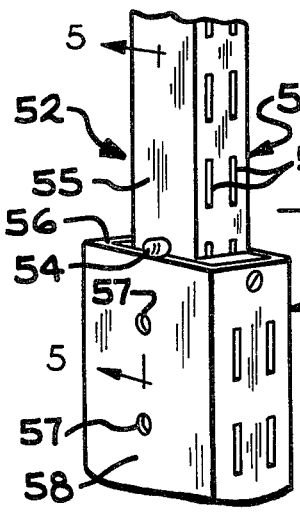
FIG. 4 is a perspective view of an extensible slotted upright illustrating a spring plunger for securing the inner and outer tubes in position.

The spacers 30, 32, 35 and 36 between the inner tube 14 and the outer tube 13 maintain a sufficient spacing between the tube sides 21 and 23 and the tube sides 22 and 24 in the overlapping region 17 to permit attaching brackets, such as shelf support brackets 45 to the outer tube 13 in the overlapping region 17 without interference from the inner tube 14. The shelf support brackets 45 are each provided with an upper T-shaped tab 46 and a lower L-shaped tab 47 for engaging two vertically adjacent slots 20. As best seen in FIG. 4, the upper tab 46 on each bracket 45 engages the tube wall both above and below the slot 20 in which the tab 46 is inserted. The lower tab 47 engages the same tube wall immediately below the slot 20 through which the tab 47 is inserted. Through this arrangement, the tabs 46 and 47 provide a strong releasable connection between the brackets 45 and the extensible slotted upright 11 to which such brackets 45 are attached. Since the wall thicknesses of the outer tube 13 and the inner tube 14 are all identical and slots 20 are provided with uniform vertical spacings, the brackets 45 may be attached equally to the outer tube 13 and to the inner tube 14, even on the outer tube 13 in the overlapping region 17 of the inner tube 14. Of course, it will be appreciated that although the brackets 45 are illustrated as shelf support brackets, other well known and commercially available fixture brackets also may be attached to extensible slotted uprights 11 with such brackets engaging the uprights 11 either on the outer tube 13, the inner tube 14 or the outer tube 13 in the overlapping region 17 between the outer and inner tubes 13 and 14.

The inner tube 14 has an upper end 48 closed by a cap or top plate 49. The cap 49 is dimensioned at least as large as the cross section of the outer tube 13 so as to abut the outer tube end 34 when the inner tube 14 is completely retracted. The cover plate 49 may be slightly larger than the cross section of the outer tube 13 to facilitate extending the inner tube 14 from the retracted position.

Figure 5:
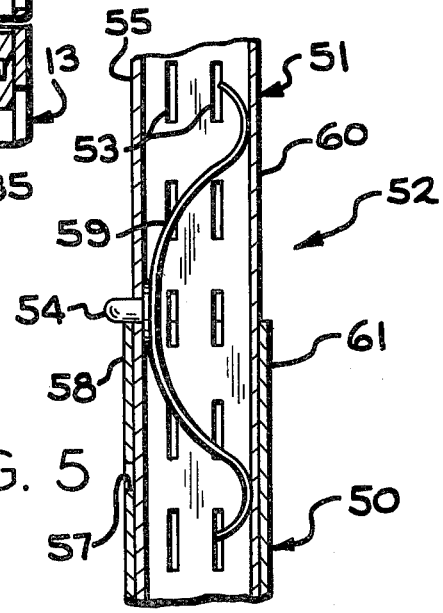
FIG. 5 is a cross sectional view along the line 5—5 in FIG. 4.

Turning now to FIGS. 4 and 5, a modified method is illustrated for interconnecting an outer tube 50 and an inner tube 51 of an extensible slotted upright 52. The outer and inner tubes 50 and 51 are provided with a plurality of spaced slots 53 similar to the slots 20 described above for the extensible slotted uprights 11. In place of the locking pins 40, the tubes 50 and 51 are maintained in a predetermined telescopic orientation by means of a plunger 54. The plunger 54 extends through a sidewall 55 of the inner tube 51 and either abuts an upper end 56 of the outer tube 50 or engages one of a plurality of spaced openings 57 in an abutting sidewall 58 of the outer tube 50. The plunger 54 is biased to extend through the inner tube sidewall 55 by a spring 59 located within the inner tube 51. The telescopic orientation of the tubes 50 and 51 is adjusted simply by depressing the plunger 54 against the spring 59 and sliding the inner tube 51 within the outer tube 50 until the plunger 54 engages a predetermined one of the openings 57 in the outer tube 50 or the upper end 56 of the outer tube 50. Although only a single plunger 54 is illustrated in FIGS. 4 and 5, it will, of course, be appreciated that separate plungers may be provided on opposite sides 55 and 60 of the inner tube 51 for simultaneously engaging opposite sides 58 and 61 of the outer tube 50 when additional strength is required.

It will be appreciated that various modifications and changes may be made in the above-described extensible slotted upright without departing from the spirit and scope of the following claims.

What I claim is:

1. An extensible slotted upright for mounting brackets which extend inwardly through slots in said upright, said upright comprising vertically oriented inner and outer tubes in telescopic engagement with each other, said inner tube having a telescoping end external to said outer tube and a retracted end within said outer tube, said tubes each having at least one side and each including a plurality of spaced apart slots along and through said at least one side for interlocking insertion of such brackets, said slotted sides of said tubes having substantially identical thickness, said tubes being oriented with respect to each other such that at least a portion of each slotted side of said outer tube lies adjacent to and in a parallel plane with a like portion of a slotted side of said inner tube, means maintaining a predetermined spacing between said adjacent and parallel slotted sides throughout the telescoping range of said inner tube in said outer tube with said predetermined spacing at least as great as the distance by which brackets inserted into said slots extend inwardly beyond said slotted sides, and means for securing said inner and outer tubes in predetermined telescoping positions with respect to each other.

2. An extensible slotted upright, as defined in claim 1, wherein said inner and outer tubes are rectangular in cross section.

3. An extensible slotted upright, as defined in claim 1, wherein each of said tubes has parallel opposite sides and includes a plurality of said spaced apart slots along and through said opposite sides with each slot on one side of each said tube located directly opposite a slot on said opposite side of such tube.

4. An extensible slotted upright, as defined in claim 3, wherein said securing means comprises at least one locking pin for insertion through one pair of said directly opposite slots in one of said tubes whereby forces of gravity abut said pin against an end of the other of said tubes and limits retraction of said inner tube into said outer tube.

5. An extensible slotted upright, as defined in claim 1, wherein said securing means comprises a pin located within and extending through an opening in said inner tube, spring means biasing said pin through said opening, and means on said outer tube for receiving said pin to releasably interconnect said inner and outer tubes.

6. An extensible slotted upright, as defined in claim 1, including a cover plate having a face with dimensions at least as great as the cross sectional dimensions of said outer tube, means securing said plate over said telescoping end of said inner tube whereby said plate abuts an adjacent end of said outer tube and conceals said inner tube when said inner tube is fully retracted into said outer tube.

7. An extensible slotted upright for mounting brackets which extend inwardly through slots in said upright, said upright comprising vertically oriented inner and outer tubes having rectangular cross sections and being in telescopic engagement with each other, each of said tubes including a plurality of spaced apart slots along and through one pair of opposite sides for interlocking insertion of such brackets, each slot on one side of each tube extending directly opposite one of said slots on said opposite side, said slotted sides of said tubes having substantially identical thickness, said tubes being oriented with respect to each other with each slotted side of said outer tube, lying adjacent to and parallel with at least a portion of a slotted side of said inner tube, said adjacent and parallel sides having a prdetermined spacing therebetween at least as great as the distance by which brackets inserted into said slots extend inwardly beyond said slotted sides, spacer means between each adjacent slotted sides for maintaining said predetermined distance therebetween as said inner tube is telescoped into and out of said outer tube, and at least one locking pin for insertion through one pair of directly opposite slots in said inner tube external to said outer tube whereby force of gravity abuts said pin against an end of said outer tube and prevents retraction of said inner tube into said outer tube.

8. An extensible slotted upright, as defined in claim 7, and including means for retaining said locking pin within the pair of slots through which said locking pin is inserted.

* * * * *